United States Patent [19]

Taki et al.

[11] Patent Number: 4,908,072

[45] Date of Patent: Mar. 13, 1990

[54] IN-PROCESS FORMATION OF HARD SURFACE LAYER ON TI/TI ALLOY HAVING HIGH RESISTANCE

[75] Inventors: Kazuhiro Taki; Yasuhiro Mitsuyoshi, both of Samukawa; Takeshi Shiraki, Yokohama, all of Japan

[73] Assignee: Nippon Mining Co., Ltd., Tokyo, Japan

[21] Appl. No.: 242,336

[22] Filed: Sep. 8, 1988

[30] Foreign Application Priority Data

Sep. 10, 1987 [JP] Japan ..... 62-226867
Apr. 28, 1988 [JP] Japan ..... 63-106149

[51] Int. Cl.[4] ..... C23C 11/10

[52] U.S. Cl. ..... 148/11.5 F; 72/42; 148/19; 148/20.6; 148/133; 148/316; 148/317

[58] Field of Search ..... 148/11.5 F, 20.6, 19, 148/133, 316, 317, 18; 72/42

[56] References Cited

U.S. PATENT DOCUMENTS 3,814,212 6/1974 Latos ..... 72/42
4,055,975 11/1977 Serfozo et al. ..... 72/42
4,096,076 6/1978 Spiegelberg ..... 72/42
4,346,014 8/1982 Piucci et al. ..... 72/42
4,398,406 8/1983 Fukuda et al. ..... 72/42
4,465,524 8/1984 Dearnaley et al. ..... 148/316
4,568,398 2/1986 Vardiman ..... 148/133

FOREIGN PATENT DOCUMENTS 0161771 9/1983 Japan ..... 148/316

*Primary Examiner*—Upendra Roy
*Attorney, Agent, or Firm*—Koda & Androlia

[57] ABSTRACT

A process for producing a titanium material with excellent corrosion resistance, which comprises first applying a degree of cold working of 10% or more of the total working reduction while causing an oil to exist on the surface of the titanium material during cold working thereof and then subjecting the titanium material to in-situ heat treatment at a temperature of 300° C. or higher, thereby forming a layer with excellent corrosion resistance containing at least one of $Ti_2N$, TiC and Ti(CN) on the titanium material surface.

2 Claims, 4 Drawing Sheets

F I G. I

FIG.4(a) SCABED PART
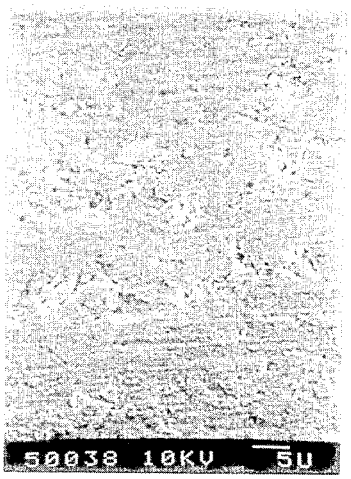
FIG.4(b) FLAT PART
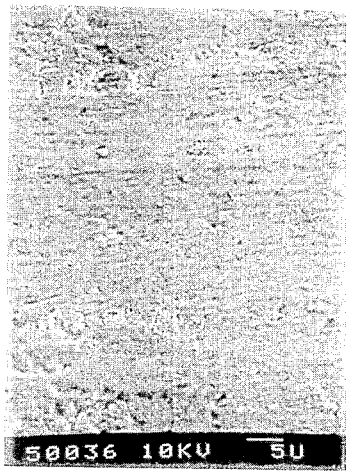

FIG.5(a) SCABED PART
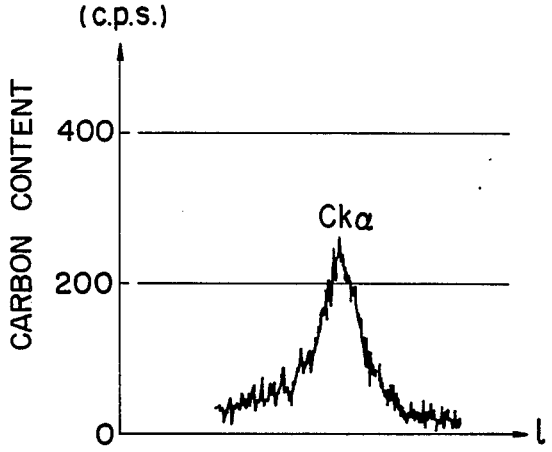
FIG.5(b) FLAT PART
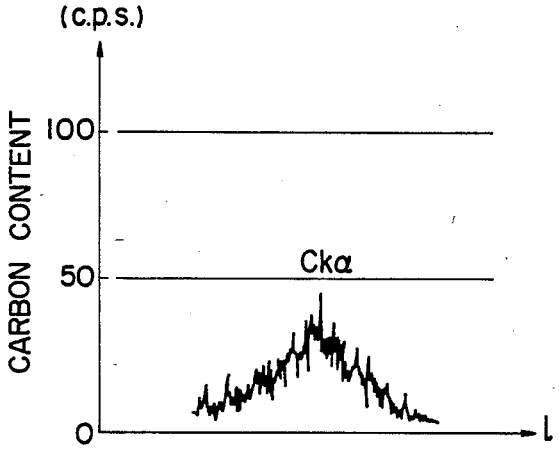

IN-PROCESS FORMATION OF HARD SURFACE LAYER ON TI/TI ALLOY HAVING HIGH RESISTANCE

BACKGROUND OF THE INVENTION

This invention relates to a process for producing a titanium material having a layer with excellent corrosion resistance formed on the surface.

Titanium which itself has excellent corrosion resistance is being used in various field but has been used under increasingly severe corrosion environments in recent years, whereby there arise problems of general corrosion or crevice corrosion.

For solving such problems, there is the method of using corrosion resistant titanium alloys such as Ti-Pd, and there is also known the method of improving corrosion resistance by a surface treatment of titanium.

However, a corrosion resistant titanium alloy such as Ti-Pd has a drawback in that the cost becomes very high because an expensive noble metal is added. In the surface treatment methods, there have been developed the method in which palladium, ruthenium or oxide thereof is applied as a coating on the surface and the method in which titanium nitride or titanium carbide is bonded to the surface by ion plating or heat treatment in gases. However, in the former method, the cost becomes high because of the use of an expensive metal, while the latter method, which is specifically atmospheric annealing, requires troublesome steps and the heat treatment temperature exceeds the transformation point, whereby there is the problem of deterioration of the titanium material.

The present invention has been accomplished in view of the above situation, and as a result of various studies on the surface treatment methods for improving corrosion resistance of titanium, the present inventors have found a process for producing a titanium material which is very simple and has remarkably increased corrosion resistance.

Briefly, it has been found that the corrosion resistance of a titanium can be remarkably improved by permitting an oil to exist on the titanium surface at the time of cold working thereof, then causing the oil to adhere firmly onto the titanium surface by performing cold working and thereafter applying heat treatment at 300° C. or higher temperature.

Based on this discovery, the present invention is intended to provide a process for producing very simply and inexpensively a titanium material of excellent corrosion resistance.

SUMMARY OF THE INVENTION

According to the present invention there is provided a process for producing a titanium material of excellent corrosion resistance, which comprises, during cold working of a titanium material, subjecting the material to 10% or more of the total degree of cold working while permitting an oil to exist on the surface of the titanium material and then subjecting the titanium material to heat treatment at a temperature of 300° C. or higher, thereby forming a layer having excellent corrosion resistance containing at least one of $Ti_2N$, TiC, Ti(CN) on the titanium material surface.

BRIEF DESCRIPTION OF THE ILLUSTRATIONS

In the illustrations:

Figure 1:
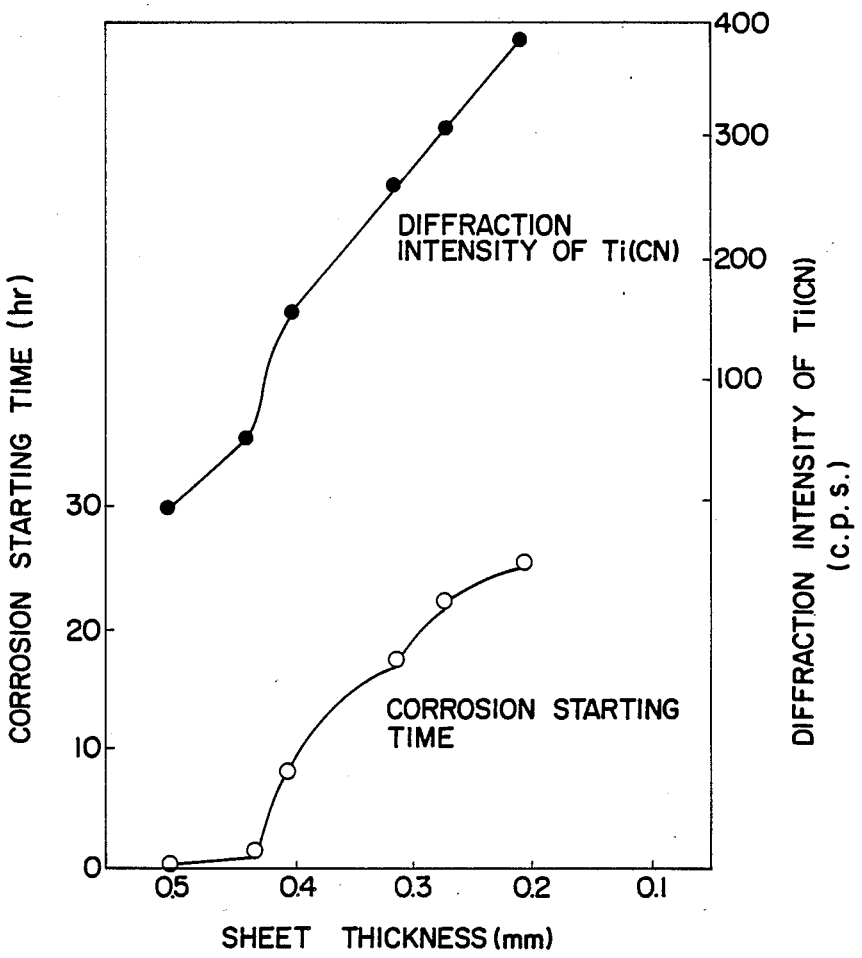
FIG. 1 is a graph showing the variation in Ti(CN) formation during cold working.

FIGS. 4(*a*) and 4(*b*) are SEM photographs of the surface of the titanium metal structure subjected to heat treatment after cold working; and FIGS. 5(*a*) and 5(*b*) are graphs of the result of carbon analysis of the portion shown in FIG. 4 by EPMA.

DETAILED DESCRIPTION OF THE INVENTION

In the present invention, an oil is permitted to exist on the titanium surface during cold working because the active titanium surface generated during working is caused to react with the oil, and at the same time the oil is baked by the heat generated thereby, but corrosion resistance cannot be improved only with such treatment. By performing thereafter heat treatment at 300° C. or higher temperature, the oil firmly adhering to the surface is decomposed to react with titanium to form a surface layer, which improves remarkably the corrosion resistance.

In order to determine the nature of the mechanism in greater detail, the titanium surface resulting when pure titanium (Grade 2) was worked to a thickness of from 0.5 mm to 0.2 mm by cold rolling with the use of an oil for rolling and then subjected to heat treatment in an argon atmosphere at 650° C. for 3 hours was observed by SEM. The result is shown in the photograph in FIG. 4, in which it can be seen that the surface is not flat but there can be seen some places on which titanium turns to form so-called "scabs". Such scabs may be formed during rolling of active titanium through baking of titanium onto rolls heated to high temperature by the working heat or formation of unevenness by adherence of a part thereof again onto titanium, which is then extended by rolling to form scabs as seen in the photograph. When carbon analysis was conducted for the vicinity of the scab and the flat place by EPMA (electron probe micro analyzer), it was found that a great amount of carbon exists in the vicinity of the scab as compared with the flat portion as shown in FIG. 5. Thus, it was found that there are Ti(CN), TiC with high corrosion resistance in this portion along with the result of X-ray analysis as described below.

From these results, we speculated the mechanism of the corrosion resistant film generation as follows.

First, heat of working is generated during rolling to cause peel-off or adhesion of titanium, whereby unevenness is formed on the titanium surface. The oil for rolling becomes entrained in that unevenness or is baked to be caught by the titanium. The rolling oil, which is firmly caught throughcontact with active titanium or the scab of titanium, is not scattered outside by subsequent heat treatment. But by the heat treatment at a temperature as same as or higher than the decomposition temperature of the oil, titanium, which is a kind of active metal reacts with the decomposed oil to form products of Ti(CN), TiC, $Ti_2N$, and, by the film products, corrosion resistance is remarkably improved.

From these considerations, it can be understood that the necessary conditions for the present invention are the three of (1) presence of oil, (2) catching of oil by working and (3) heat treatment. The kind of oil is not limited to the oil for rolling, but any oil similar thereto may be employed. It has also found by us that catching of oil is influenced primarily by the degree of working.

FIG. 1 shows the result of X-ray diffraction intensity of Ti(CN) and corrosion tests of the samples which was taken at appropriate rolling reduction, when pickled titanium coil of 0.5 mm thickness (Grade 2) was cold-rolled to 0.2 mm thickness with a oil, and subsequently annealed at 650° C. for 3 hours. X-ray diffraction was performed by the use of a Cu tube bulb, under the conditions of a tube current of 16 mA, a tube voltage of 30 KV, and the peak at a diffraction angle ($2\theta$) of 36.1° was taken as the diffraction intensity of Ti(CN).

On the other hand, corrosion resistance was evaluated by the durable time, namely how long the corrosion did not start after the sample was dipped into a boiled 5% HCl aqueous solution. The start time of the corrosion was confirmed by generation of hydrogen gas and weight reduction of the sample. Under such conditions, corrosion of ordinary titanium without corrosion resistant film according to the present invention begins simultaneously with dipping, whereby generation of hydrogen gas and weight reduction can be observed.

As can be seen from FIG. 1, in the sample material before rolling, no Ti(CN) is observed at all, and it can be seen that corrosion also commences immediately in the corrosion test. The X-ray diffraction intensity of Ti(CN) of the cold-rolled sample is substantially increased in proportion to its working reduction, and improvement of corrosion resistance can be seen substantially correspondingly. However, at a working reduction less than 10%, although the intensity of Ti(CN) may be elevated, perhaps due to the existing amount of Ti(CN) which is yet small, no remarkable increase of corrosion resistance can be seen. From this fact, it becomes necessary to regulate the lower limit of the working reduction to 10%.

Furthermore, the factors influencing corrosion resistant film formation of Ti(CN), etc., include rolling speed, amount of rolling oil, product dimensions, etc. However, these factors will have no vital influence on the fluctuations under the conventional conditions for rolling pure titanium. For example, the rolling speed of titanium is ordinarily 100 to 300 m/min., but even when rolling is performed at an extremely slow speed of 10 m/min., or, on the contrary, at a high speed of 600 m/min., formation of corrosion resistant film such as Ti(CN), etc., was confirmed. Also, as to the amount of oil for rolling, rolling is generally performed while causing an oil for rolling to flow, but even when rolling is carried out only with the oil for rolling adhering to the roll with flow of the oil for rolling stopped, corrosion resistant film of Ti(CN), etc., could be sufficiently formed. With respect to product dimensions, in both a titanium coil of 1 ton and a titanium of only 50-mm width and 300-mm length, Ti(CN) was observed.

While the manner in which oil is entrapped on the titanium has been described above, a corrosion-resistant film cannot be obtained only by such treatment, but the oil is decomposed by subsequent heat treatment at a temperature of 300° C. or higher to produce films of Ti(CN), $Ti_2N$ and TiC.

Ordinarily, such heat treatment is conducted in vacuum or in an inert gas, but the effect of corrosion resistance is not changed even by heat treatment in the air, although oxide films of TiO, $TiO_2$ may be formed. The heat treatment temperature is preferably from 550° C. to 870° C., and by heat treatment within this range, complete decomposition of the oil and the reaction with titanium occur, whereby an even better titanium product together with excellent micro-structure can be obtained.

The layer (film) of excellent corrosion resistance of the present invention contains generally TiO and other complex oxides. The present invention is intended to include also these as a matter of course.

As the method for practicing the above invention, for example, cold working is performed in the presence of the oil, and after 10% or more working reduction is operated, heat treatment is carried out at 300° C or higher in vacuum or an inert gas (or in the air when the surface may be oxidized), whereby a titanium material of remarkably excellent corrosion resistance can be simply obtained.

EXAMPLES

For presenting evidence of the justification of the constitution of the present invention and its mechanism as described above, the following examples are set forth.

A pure titanium (Grade 2) plate with a thickness of 2 mm, cleaned of contamination, etc., on the surface by pickling as the sample material, was subjected to cold rolling to working degrees of 5%, 10%, 40% and 70%, and subjected to no rolling whatsoever (working degree 0%), for two cases of using and not using a rolling oil. Subsequently, they were heat-treated respectively at from 200° to 1000° C. in vacuum. The specimens which was not cold-rolled or heat-treated were also ready as a comparison. Furthermore, the specimens which was just painted with an oil without cold-rolling and subsequently heat-treated in vacuum were also ready Table 1 shows the results of testing the specimens mentioned above.

In Table 1, evaluation of corrosion resistance was performed by the general corrosion test and the crevice corrosion test. Corrosion resistance of the whole surface corrosion was measured by dipping the sample material in a boiled 5% aqueous HCl solution, and a test piece with weight reduction one hour later or 10 hour later, was judged to have incurred general corrosion. Corrosion resistance to the crevice corrosion was measured by dipping crevice corrosion test pieces (one having a gap formed on the titanium surface) in a boiled 10% aqueous NaCl solution and taking out the sample after 5 days to examine whether crevice corrosion occurred or not. The probability of crevice corrosion was calculated from the tests mentioned above.

As can be seen from Table 1, first for the materials not rolled, it can be seen that corrosion resistance cannot be improved at all even when heat treatment is carried out after coating of a rolling oil.

Also, even when cold rolling of 10% or more is carried out (rolling at 300° C. or lower temperature carried out), no improvement of corrosion resistance can be seen as far as oil is not used and/or heat-treated at 200° C. or lower temperatures.

TABLE 1

| Working reduction % | Presence of the oil for rolling | Heat treatment temperature (°C.) | (Note 1) General corrosion resistance | (Note 2) Probability of crevice corrosion (%) |
|---|---|---|---|---|
| | (Results of corrosion resistance tests of various treated materials) | | | |
| 0 | Painted with an oil | no heat treatment | X | 100 |
| | | 200 | X | 100 |
| | | 300 | X | 90 |
| | | 700 | X | 100 |
| | | 1000 | X | 80 |
| | Not painted with an oil | no heat treatment | X | 90 |
| | | 200 | X | 100 |
| | | 300 | X | 90 |
| | | 700 | X | 90 |
| | | 1000 | X | 100 |
| 5 | Cold-rolled with an oil | no heat treatment | X | 80 |
| | | 200 | X | 80 |
| | | 300 | X | 90 |
| | | 700 | X | 100 |
| | | 1000 | X | 90 |
| | Cold-rolled without any oil | no heat treatment | X | 100 |
| | | 200 | X | 80 |
| | | 300 | X | 100 |
| | | 700 | X | 70 |
| | | 1000 | X | 100 |
| 10 | Cold-rolled with an oil | no heat treatment | X | 100 |
| | | 200 | X | 100 |
| | | 300 | Δ | 40* |
| | | 700 | Δ | 30* |
| | | 1000 | Δ | 30* |
| | Cold-rolled without any oil | no heat treatment | X | 100 |
| | | 200 | X | 100 |
| | | 300 | X | 100 |
| | | 700 | X | 90 |
| | | 1000 | X | 100 |
| 40 | Cold-rolled treatment with an oil | no heat | X | 70 |
| | | 200 | X | 90 |
| | | 300 | | 0* |
| | | 700 | | 0* |
| | | 1000 | | 0* |
| | Cold-rolled without any oil | no heat treatment | X | 90 |
| | | 200 | X | 100 |
| | | 300 | X | 100 |
| | | 700 | X | 100 |
| | | 1000 | X | 100 |
| 70 | Cold-rolled with an oil | no heat treatment | X | 100 |
| | | 200 | X | 100 |
| | | 300 | | 0* |
| | | 700 | | 0* |
| | | 1000 | | 0* |
| | Cold-rolled without any oil | no heat treatment | X | 90 |
| | | 200 | X | 80 |
| | | 300 | X | 100 |
| | | 700 | X | 100 |
| | | 1000 | X | 100 |

Note 1:
not corroded even after 10 hours
Δ corrosion occurred within 1 to 10 hours
X corrosion occurred within 1 hour
Note 2:
Probability of crevice corrosion (%) =

$$\frac{\text{Number of test pieces which crevice corrosion occurred} \times 100}{\text{Number of tested pieces}}$$

The mark * indicates the method according to the present invention.

On the other hand, among the specimen which was cold-rolled to more than 10% working reduction, the test pieces which was cold-rolled with an oil and subsequently heat-treated at more than 300° C., have perfect corrosion resistance because of being free from not only general corrosion after 5 hours but also crevice corrosion after 5 days from the result of Table 1, whereby it can be seen how the material prepared according to the process of the present invention has excellent corrosion resistance.

Figure 2:
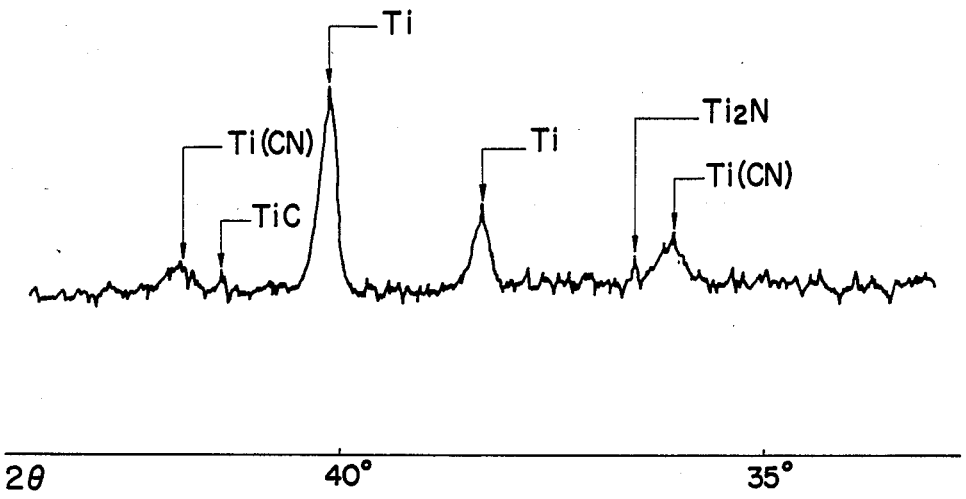
FIG. 2 is an X-ray diffraction chart of the surface of the titanium material according to an example of the invention.

In order to clarify the mechanism of such remarkable improvement of corrosion resistance, the surface of the pure titanium plate prepared according to the process of the present invention was subjected to X-ray analysis. As a result, a chart as shown in FIG. 2 was obtained. Except for peaks those of titanium, those of $Ti_2N$, TiC and Ti(CN) were observed, so that it could be seen that these corrosion resistant materials were formed on the titanium surface.

Figure 3:
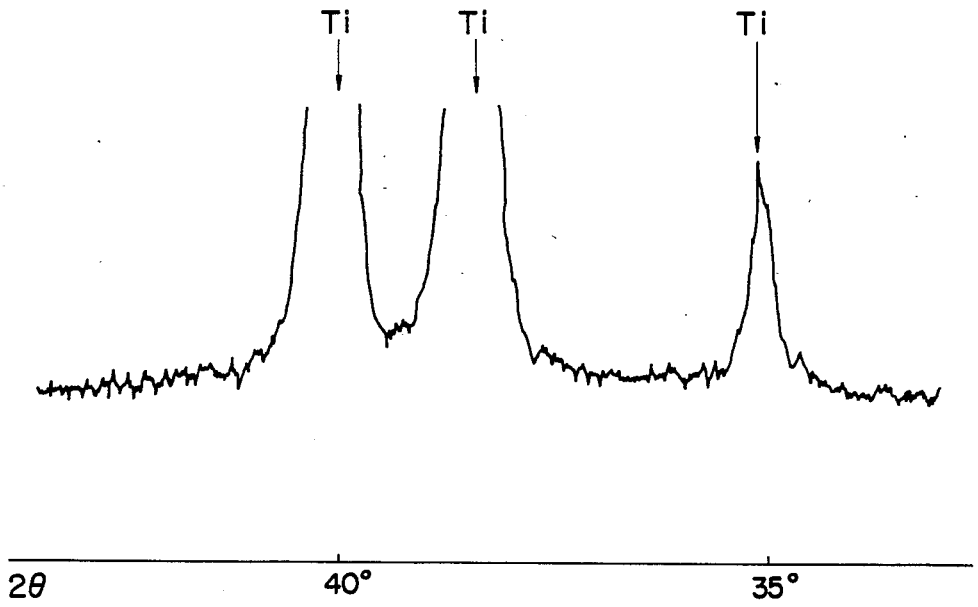
FIG. 3 is an X-ray diffraction chart of the surface of the pure titanium material as cold rolled with the use of the oil for rolling.

On the other hand, the result of X-ray diffraction of the surface of the pure titanium plate which was cold-rolled with an oil and subsequently did not heat-treated is shown in FIG. 3, in which no peak other than those of titanium appears. From these facts, it can be seen that the rolling oil adhering firmly during rolling is decomposed by heat treatment to form $Ti_2C$, TiC, Ti(CN), whereby corrosion resistance is improved.

The oil used in the tests mentioned above was for rolling, but otherwise, oils such as heavy oil, kerosene oil, light oil, lubricant oil, etc., can also be used to give similar effects.

Also, the working reduction of the present invention means the total working reduction because the corrosion resistant film of the present invention can be continuously formed even when the step of not eliminating the titanium surface such as annealing or degreasing is included in the process. When the step of eliminating the titanium surface such as pickling, polishing, etc., is included in the process, the process of forming the corrosion resistant film is interrupted.

The material according to the present invention is not regulated to only pure titanium. It also includes corrosion resistant titanium alloys such as Ti-Pd, Ti-Ni-Mo, Ti-Ru-Ni, and Ti-Ta alloys, and construction titanium alloys such as Ti-6Al-4V, Ti-15V-3Al-3Sn-3Cr, Ti-5Al-2.5Sn because such titanium alloys can easily form Ti(CN), $Ti_2N$ and/or TiC on their surface by working as well as in the case of pure titanium.

As is apparent from the above example, the titanium material produced according to the process of the present invention has remarkably high corrosion resistance, and therefore it can be used under an environment of aqueous solutions of HCl, $H_2SO_4$, $HNO_3$, etc., in chemical plants or places where gap corrosion is likely to occur. Also, it is available for batteries. Particularly in the case of using strong corrosive substance such as lithium battery, pure titanium (produced not according to the present invention) may be sometimes corroded. In this case, the titanium material according to the present invention has been recognized to be amply resistant under such an environment.

As an example, when the titanium material according to the present invention and other titanium materials were subjected to lath working, then coated with carbon fluoride and so on as the active material, and resistance was measured after a certain period of time, the material according to the present invention was found to have low resistance of 2Ω, while a titanium material other than that of the present invention acquires an extremely high resistance of 7Ω, which is unsuitable for a battery. When carbon fluoride was removed and the surface was observed by SEM, it was found that corrosion products were formed on the surface of the titanium material other than that of the present invention. Thus, it was understood that corrosion products were resulted from corrosion, whereby resistance was increased. The material according to the present invention was found to undergo no change whatsoever on the surface without corrosion as the result of SEM observation.

From these results, the titanium material according to the present invention is also the optimum as a material for batteries.

According to the process of the present invention as described above, since a layer containing $Ti_2N$, TiC, Ti(CN) is formed on the surface of the titanium material, a titanium material of excellent corrosion resistance can be provided.

What is claimed is:

1. A process for producing a titanium material with excellent corrosion resistance, which comprises:

subjecting a titanium material to cold working while causing an oil to exist on the surface of the titanium material, the degree of said cold-working being 10% or more of the total working reduction;

and then subjecting the titanium material to heat treatment at 300° C. or higher temperatures to thereby react the titanium material with nitrogen and/or carbon contained in the oil to form a layer which excellent corrosion resistance containing at least one of the $Ti_2N$, TiC, and Ti(CN) on the titanium material surface.

2. A process according to claim 1, wherein the titanium material comprises titanium and/or an alloy thereof.

* * * * *

UNITED STATES PATENT AND TRADEMARK OFFICE

CERTIFICATE OF CORRECTION

PATENT NO. : 4,908,072

DATED : March 13, 1990

INVENTOR(S) : Kazuhiro Taki, et al.

It is certified that error appears in the above-identified patent and that said Letters Patent is hereby corrected as shown below:

ON TITLE PAGE:

Column [54]: Change "IN-PROCESS FORMATION OF HARD SURFACE LAYER ON TI/TI ALLOY HAVING HIGH RESISTANCE" to --IN-PROCESS FORMATION OF HARD SURFACE LAYER ON TI/TI ALLOY HAVING HIGH CORROSION RESISTANCE--

Signed and Sealed this

Twenty-fifth Day of February, 1992

*Attest:*

*Attesting Officer*

HARRY F. MANBECK, JR.

*Commissioner of Patents and Trademarks*